US006591623B2

(12) United States Patent
Lee

(10) Patent No.: US 6,591,623 B2
(45) Date of Patent: Jul. 15, 2003

(54) KIM-CHI REFRIGERATOR HAVING A HEATER FOR A VEGETABLE CHAMBER

(75) Inventor: Young-gil Lee, Asan-shi (KR)

(73) Assignee: Mando Climate Control Corporation, Chungcheongnam-Do (KR)

( * ) Notice: Subject to any disclaimer, the term of this patent is extended or adjusted under 35 U.S.C. 154(b) by 66 days.

(21) Appl. No.: 09/946,767

(22) Filed: Sep. 5, 2001

(65) Prior Publication Data

US 2002/0069659 A1 Jun. 13, 2002

(30) Foreign Application Priority Data

Sep. 21, 2000 (KR) ..... 2000-55353

(51) Int. Cl.[7] ..... F25D 21/08

(52) U.S. Cl. ..... 62/234; 62/275; 62/273

(58) Field of Search ..... 62/150, 151, 152, 62/156, 272, 273, 275, 276, 283, 155, 234

(56) References Cited

U.S. PATENT DOCUMENTS

| | | | | |
|---|---|---|---|---|
| 3,006,158 A | * | 10/1961 | Horvay | 62/273 |
| 5,388,427 A | | 2/1995 | Lee | 62/331 |
| 5,546,759 A | | 8/1996 | Lee | 62/441 |
| 6,324,853 B1 | * | 12/2001 | Kelly et al. | 62/275 X |

* cited by examiner

*Primary Examiner*—Harry B. Tanner
(74) *Attorney, Agent, or Firm*—Fish & Richardson P.C.

(57) ABSTRACT

The present invention provides a compound type Kim-chi refrigerator having a heater composed of the electrically heated wire to the backside of a vertical partition wall defining vegetable chamber for maintaining the temperature of the vegetable chamber within a predetermined temperature range and removing the frost within the vegetable chamber. The compound type Kim-chi refrigerator according to the present invention comprise a heater 9 attached to the lower part of the condensed water vent formed on the vertical partition wall 6*b* defining the vegetable chamber 61 to remove the frost and heat the vegetable chamber 61 properly to the predetermined temperature range.

3 Claims, 4 Drawing Sheets

KIM-CHI REFRIGERATOR HAVING A HEATER FOR A VEGETABLE CHAMBER

BACKGROUND OF THE INVENTION (1) Field of the Invention

The present invention relates to a Kim-chi refrigerator consisting a heater for the vegetable chamber, and more specifically to a compound type Kim-chi refrigerator having a heater composed of the electrically heated wire to the backside of a vertical partition wall defining vegetable chamber for maintaining the temperature of the vegetable chamber within a predetermined temperature range and removing the frost within the vegetable chamber.

(2) Description of the Prior Art

In general, a refrigerator is a kind of cooling apparatus. The refrigerants are condensed and liquefied under a high pressure by using a condenser. The condensed refrigerants are moved to an expansion valve assembled with a tube of a small diameter. Here, the refrigerants are instantaneously vaporized in an evaporator, and thus a temperature is dropped to generate cooling air. The cooling air is supplied to a main body of the refrigerator, thus maintaining the freshness of the food in the refrigerator.

The refrigerant vaporized in the evaporator by absorbing heat are moved from a compressor to a condenser, and condensed and liquefied in the condenser, discharging heat. Thereafter, the above-described procedure is repeated to continuously perform the cooling operation.

On the other hand, a Kim-chi refrigerator introducing the refrigerating principle to ripen Kim-chi and maintain the freshness of Kim-chi has been popularly used. Such a Kim-chi refrigerator is small sized. Accordingly, while a general refrigerator has a door on the front side, the Kim-chi refrigerator has a door on the top surface with a hinge.

A cooling and heating device is included inside the Kim-chi Refrigerator. Accordingly, when ripening Kim-chi, a temperature inside the container is raised by making the heater operate as a heating device, thereby ripening Kim-chi kept in a containing room. After ripening Kim-chi properly, the heater stops and simultaneously a cooling device is operated, so the temperature of the containing room is maintained properly, thereby capable of maintaining Kim-chi for a long period of time with its taste and freshness.

Recently, a drawer type Kim-chi refrigerator has been suggested to insert a drawer into its main body. The upper opening and shutting type Kim-chi refrigerator has a Kim-chi storage room positioned vertically and the door mounted on the Kim-chi storage room to open upward, and the drawer type Kim-chi refrigerator has a drawer consisting a Kim-chi storage room positioned horizontally. Recently the compound type Kim-chi refrigerator with an upper door of the upper opening and closing type Kim-chi refrigerator and a drawer of the drawer type Kim-chi refrigerator has been developed and in use.

The conventional compound type Kim-chi refrigerator has the same structure as shown in the FIGS. 1*a* and 1*b*.

As shown in these FIGS. 1*a* and 1*b,* two Kim-chi storage rooms 20 are divided and formed in the body 10 of Kim-chi refrigerator constituting the outer appearance, and two upper doors 30 for opening and closing these two Kim-chi storage rooms 20 are mounted by the hinge 40. Each upper door 30 is constituted to open with the lift upward by the hinge 40.

In Kim-chi storage rooms 20, the separate Kim-chi storage vessels 21 are inserted to ripen and store Kim-chi.

Also, on the lower portion of the Kim-chi storage rooms 20, a drawer 53 providing the drawer type storage room 50 is positioned. Usually, this drawer type storage room 50 is designed to be used mainly as the vegetable chamber. This vegetable chamber maintains the indoor temperature by the cool air supplied from the evaporator 100 installed separately.

This drawer 53 has the space portion by the receipt barrel 51 to store the vegetables etc, and the front door plate having a handle 52 to open and close by pulling or pushing this receipt barrel 51. On the backside of the drawer type storage room 50, the machine room 70 is separated and formed positioning the compressor 60 and condenser to constitute the cooling unit.

The control of all the operations of Kim-chi refrigerator is established through the modulating panel 80 provided on the front side of the body 10, and the insulating material 90 is filled inside the body 10 through the foaming molding to raise the insulating effect from the exterior air.

In the drawer type Kim-chi refrigerator, since the drawer type storage room used mainly as a vegetable chamber restores vegetables or fruits, this must keep the indoor temperature (usually, about 0° C.–5° C.) in the degree of maintaining the freshness of the vegetables or fruits, and the indoor temperature of the drawer type storage room is maintained with proper temperature by the cool air occurring from the evaporator installed in the drawer type storage room.

But, by the continual operation of the evaporator to supply the cool air into the conventional drawer type storage room, the temperature of vegetable chamber falls below the predetermined temperature range with the probability of frost in the vegetable chamber and the freezing of the stored vegetables and fruits.

SUMMARY OF THE INVENTION

It is an objective of the present invention to provide a Kim-chi refrigerator having a heater for a vegetable chamber which can remove the frost in the vegetable chamber by attaching the heater composed of the electrically heated wire to the backside of a vertical partition wall defining the vegetable chamber and keeping the temperature of the vegetable chamber within the scope of the predetermined temperature range by heating the vegetable chamber when the temperature of the vegetable chamber with the heater falls below the lowest predetermined temperature.

In accordance with this present invention a Kim-chi refrigerator consisted of the first two Kim-chi storage rooms with opening and closing type upper door respectively and a drawer having a third Kim-chi storage room as a vegetable chamber for storing the vegetables and fruits, a compressor for compressing the refrigerant, a condenser for condensing and liquefying the compressed refrigerant, and a numerous of evaporators corresponding to the first to third Kim-chi storage rooms in the machine room, which comprise: a heater attached to the lower portion of the condensed water vent formed on the backside of a vertical partition wall defining the vegetable chamber to remove the frost and heat the vegetable chamber properly to the predetermined temperature range.

It is preferable that the frost removing work of the heater is accomplished periodically in said vegetable chamber when the predetermined time has passed after the operation of the cooling cycle, and the heating prodess of the heater is operated by the falling of the vegetable chamber temperature below the lowest predetermined temperature.

And it is preferable that the temperature of the vegetable chamber is set to 0° C.–5° C.

BRIEF DESCRIPTION OF DRAWINGS

Other objectives and aspects of the present invention will become apparent from the following description of the embodiments with reference to the accompanying drawing in which.

DESCRIPTION OF THE PREFERRED EMBODIMENTS

Figure 1A:
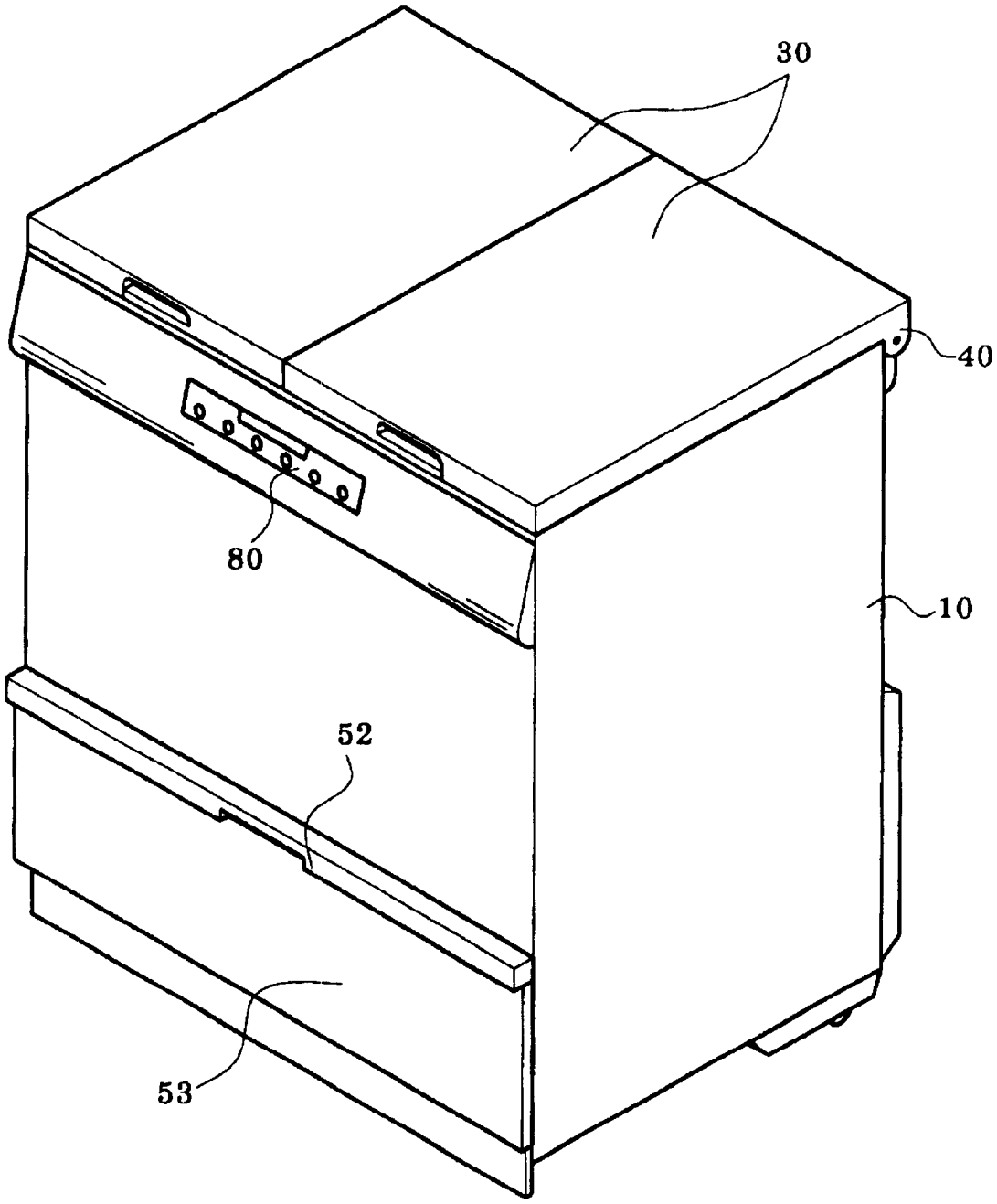
FIG.1a (PRIOR ART)
FIGS. 1*a* and 1*b* are perspective view and sectional view of the conventional compound type Kim-chi refrigerator respectively.
Figure 1B:
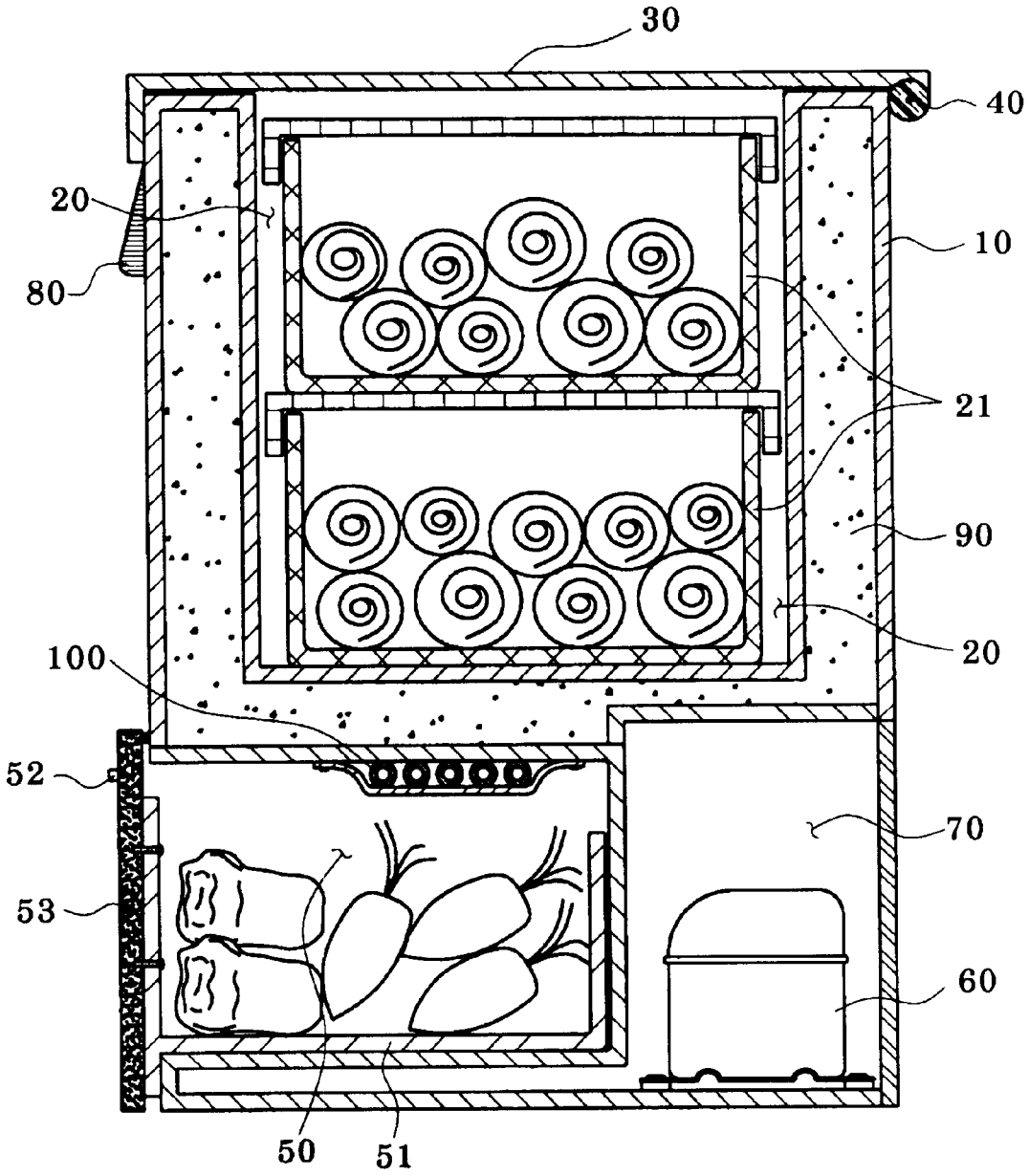
FIG.1b (PRIOR ART)
Figure 2:
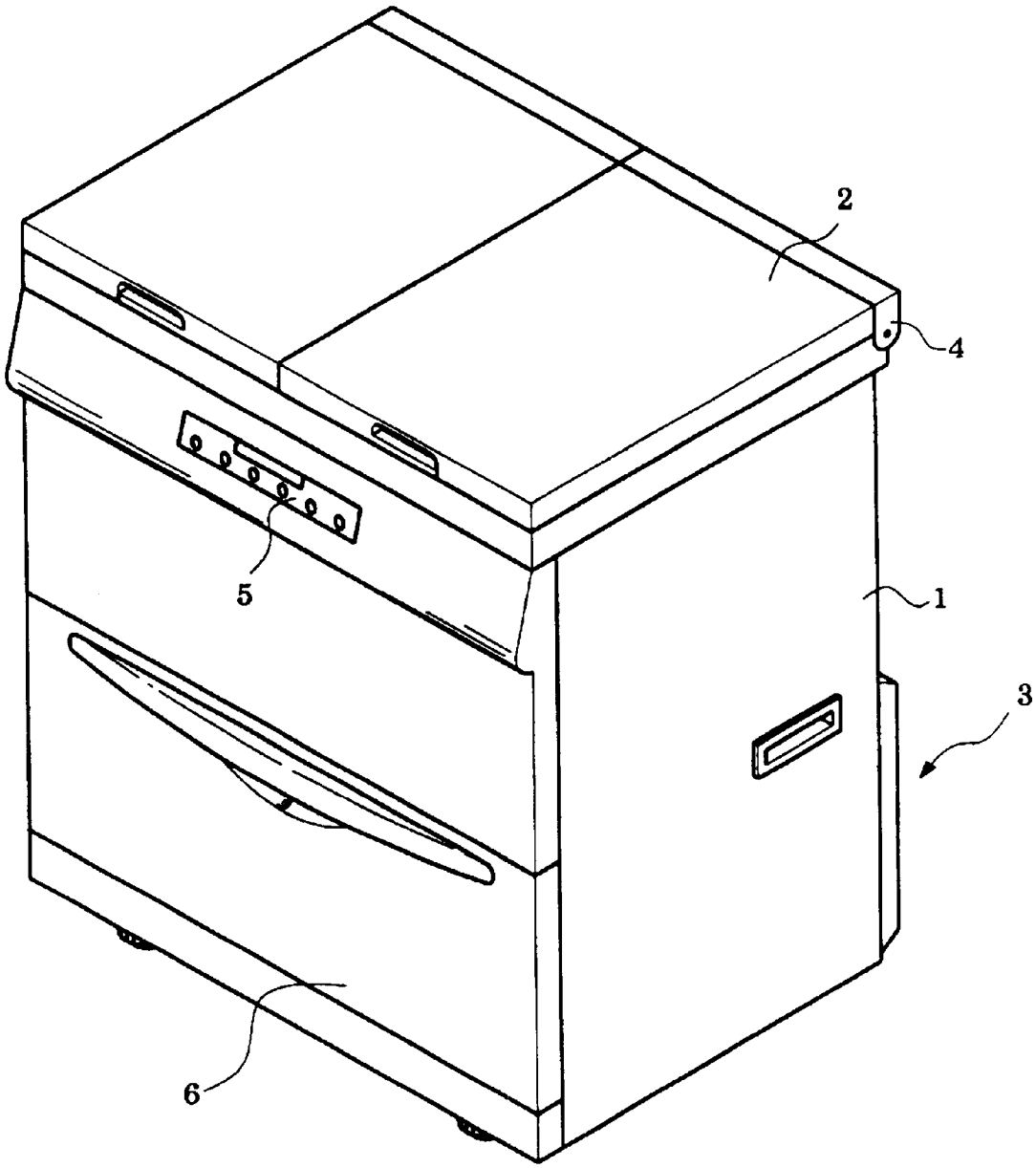
FIG. 2 is a perspective view of a compound type Kim-chi refrigerator according to the present invention.

As shown in the FIG. 2, the compound type Kim-chi refrigerator according to the present invention has the first and the second Kim-chi storage rooms to ripen and refrigerate Kim-chi, prolonged and formed to the lower part vertically, and on the first and the second storage rooms, each door 2 is installed to open and close to the upper portion of the body 1 by the hinge 4. Meanwhile, the drawer 6 providing a third Kim-chi storage room 61 is designed to be used mainly as the vegetable chamber for storing the vegetables and Kim-chi. Hereinafter, the third Kim-chi storage room also refers to the vegetable chamber designated with numeral 61.

In this compound type Kim-chi refrigerator, the cooling unit is provided with the same constitution and function as the upper portion opening and closing type Kim-chi refrigerator or drawer type Kim-chi refrigerator.

This compound type Kim-chi refrigerator comprises the body 1 having the modulating panel 5 of the front upper portion, two upper doors 2 to open and close these two Kim-chi storage rooms are mounted by the hinge 4. Each upper door 2 is constituted to open by lifting upward from the hinge 4.

Also, on the backside of the drawer 6 providing a vegetable chamber 61, the machine room 3 is provided, and within which the compressor, the condenser, the blower, and the solenoid valve are installed.

Figure 3:
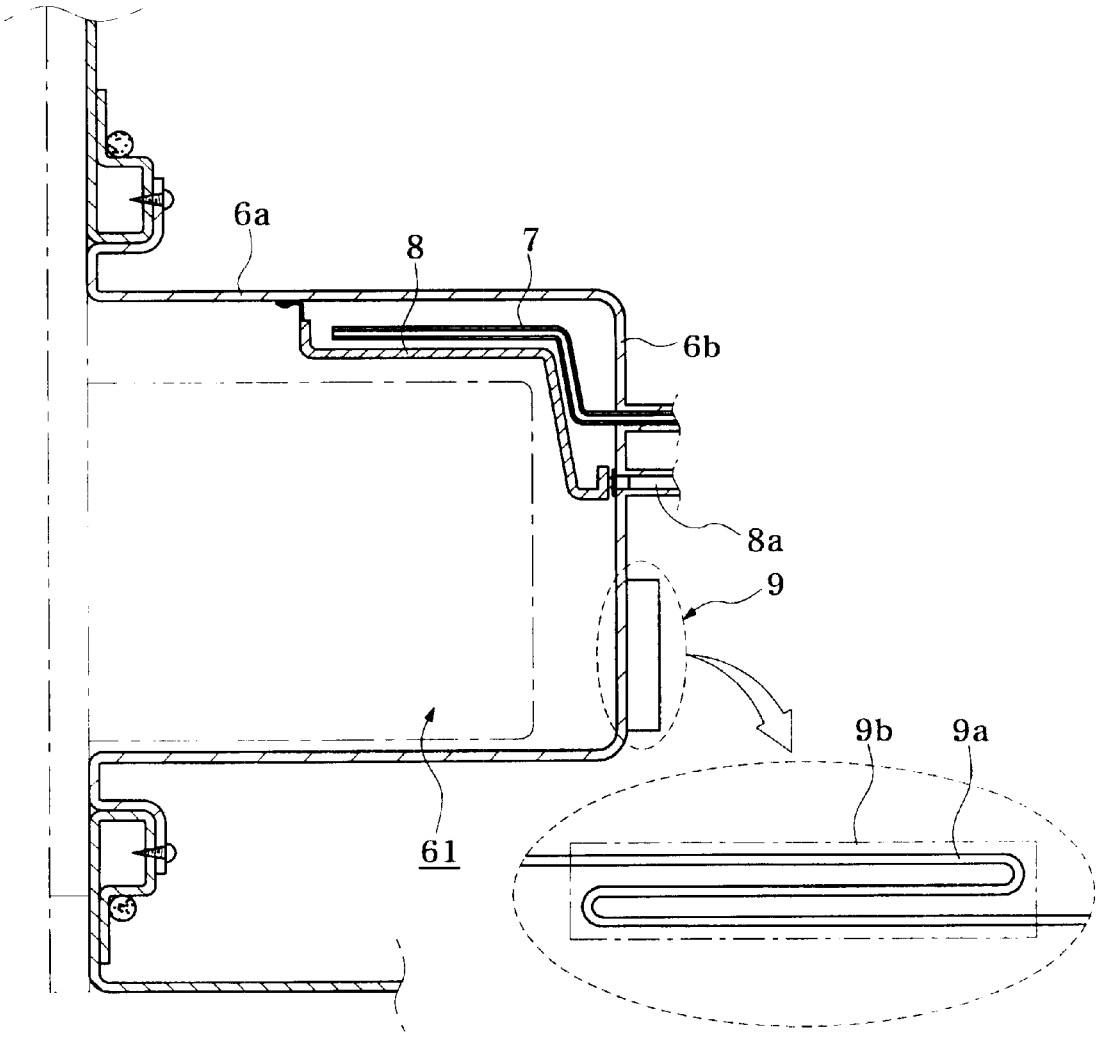
FIG. 3 is an enlarged sectional view of a compound type Kim-chi refrigerator in accordance with the present invention.

As shown in the FIG. 3, on the interior upper partition wall of the drawer 6, the evaporator 7 formed in the latticed type and the drain members capable of venting out the condensed water formed by the cooling function of the evaporator 7 are installed.

Also, the vegetable chamber 61 is designed mainly to store the vegetables or fruits as above mentioned, and this must keep the indoor temperature in the degree of maintaining the freshness of the vegetables or fruits.

At this point, the temperature of the vegetable chamber 61 is cooled through the cool air formed from the evaporator 7 installed within the vegetable chamber 61, and if the temperature of the vegetable chamber 61 falls below a certain temperature (for example, 0° C.) with continual operation of the cooling cycle, the vegetables or fruits with moisture may freeze.

Accordingly, as above mentioned, the vegetable chamber 61 must maintain the temperature of 0° C.–5° C. or so in which the vegetables and fruits can be stored fresh without freezing.

For this purpose, the compound type Kim-chi refrigerator of the present invention is provided with a heater 9 to keep the temperature of the vegetable chamber 61 within the scope of 0° C.–5° C. or by heating the vegetable chamber 61 to prevent the vegetables from freezing in case the temperature of the vegetable chamber 61 falls below a certain temperature. The heater 9 as the heating means is attached to the backside of the vertical partition wall 6*b* consisting the vegetable chamber 61.

As shown in the FIG. 3, the heater 9 composed of the electrically heated wire 9*a* is installed on the lower portion of the condensed water vent 8*a*, which emits the condensed water gathered in the drain members 8.

In the attachment of the electrically heated wire 9*a* to the vertical partition wall 6*b*, the use of the adhesive tape 9*b* with the quality of aluminum is suitable.

Although the heater 9 is operated when the temperature of the vegetable chamber falls below the predetermined temperature, it is also operated in frost removing function when the evaporator is frosted with the continual work of the cooling cycle. The series of this work is accomplished by the control unit (not shown) provided within the machine room. That is, when the temperature of the vegetable chamber falls below certain temperature by the continual operation of the evaporator 7, the control unit provides electrical signal to the heater 9 to accomplish the frost removing function in the vegetable chamber.

As above mentioned, when the temperature of the vegetable chamber 61 falls below the lowest predetermined temperature (for example, 0° C.), the heater 9 heats itself with electricity according to the control signal transmitted from the control unit, and the temperature of the vegetable chamber can be maintained constant by the rising temperature of the vegetable chamber 61 with heater 9.

According to the present invention as above mentioned, the heater is attached to the backside of the vertical partition wall defining the vegetable chamber, the frost in the vegetable chamber can be removed, and when the temperature of the vegetable chamber falls below the lowest predetermined temperature, the vegetables and fruits in the vegetable chamber can be stored fresh to raise the credibility for the product by heating the heater to keep the temperature of the vegetable chamber within the scope of the predetermined temperature.

What is claimed:

1. A Kim-chi refrigerator consisted of a first Kim-chi storage room and a second Kim-chi storage room with opening and closing type upper door respectively and a drawer consisting a third Kim-chi storage room as a vegetable chamber for storing the vegetables and fruits, a compressor for compressing the refrigerant, a condenser for condensing and liquefying the compressed refrigerant, and numerous evaporators corresponding to the first to third Kim-chi storage rooms in the machine room, which comprise:

a heater attached to the lower portion of the condensed water vent formed on the backside of a vertical partition wall defining the vegetable chamber to remove the frost and heat the vegetable chamber properly to the predetermined temperature range.

2. A Kim-chi refrigerator of claim 1, wherein the frost removing function of the heater is accomplished periodically in said vegetable chamber when the predetermined time has passed after the operation of the cooling cycle, and the heating function of the heater is operated with the falling temperature of the vegetable chamber below the lowest predetermined temperature.

3. A Kim-chi refrigerator of claim 1 or 2, wherein the temperature of the vegetable chamber is set to 0° C.–5° C.

* * * * *